US006227938B1

(12) United States Patent
Cheetham et al.

(10) Patent No.: US 6,227,938 B1
(45) Date of Patent: May 8, 2001

(54) GUIDEWIRE POSITION LOCATOR

(75) Inventors: Charles J. Cheetham, Wayne; Boris M. Olevskiy, Fair Lawn; Edmund Smith, Wayne, all of NJ (US)

(73) Assignee: Royal Masters Grinders, Inc., Oakland, NJ (US)

( * ) Notice: Subject to any disclaimer, the term of this patent is extended or adjusted under 35 U.S.C. 154(b) by 0 days.

(21) Appl. No.: 09/392,031

(22) Filed: Sep. 8, 1999

Related U.S. Application Data

(60) Provisional application No. 60/099,454, filed on Sep. 8, 1998.

(51) Int. Cl.[7] ..... B24B 49/00
(52) U.S. Cl. ..... 451/6; 451/8
(58) Field of Search ..... 451/6, 5, 8, 9, 451/49, 407, 909

(56) References Cited

U.S. PATENT DOCUMENTS

| | | |
|---|---|---|
| 2,394,381 | 2/1946 | Hoern . |
| 2,402,293 | 6/1946 | Nye . |
| 2,956,378 | 11/1960 | Arlin . |
| 2,979,869 | 4/1961 | Birleson et al. . |
| 3,534,507 | 10/1970 | Barhorst . |
| 3,859,755 | 1/1975 | Schaller . |
| 3,986,774 | 10/1976 | Lowrey, Jr. et al. . |
| 4,018,011 | 4/1977 | Whittenberg . |
| 4,190,797 | 2/1980 | Licklinder et al. . |
| 4,192,102 | 3/1980 | Jessup . |
| 4,275,527 | 6/1981 | Daito et al. . |
| 4,293,913 | 10/1981 | Nishimura et al. . |
| 4,299,491 | 11/1981 | Waters et al. . |
| 4,388,816 | 6/1983 | Ferket et al. . |
| 4,396,836 | 8/1983 | Vitaliani et al. . |
| 4,558,537 | 12/1985 | MacLeod et al. . |
| 4,756,126 | 7/1988 | Pozzetti . |
| 4,777,769 | 10/1988 | McLaughlin et al. . |
| 4,818,100 | 4/1989 | Breen . |
| 4,926,603 | 5/1990 | Frost et al. . |
| 4,930,260 | 6/1990 | Itoh et al. . |
| 4,967,515 | 11/1990 | Tsujiuchi et al. . |
| 5,022,194 | 6/1991 | Schumacher . |
| 5,060,423 | 10/1991 | Klotz . |
| 5,123,213 | 6/1992 | Vinson . |
| 5,177,901 | 1/1993 | Smith . |
| 5,480,342 | 1/1996 | Bannayan et al. . |
| 5,533,931 | 7/1996 | Imai et al. . |
| 5,567,195 | 10/1996 | Tufts et al. . |
| 5,674,106 | 10/1997 | Cheetham . |
| 5,748,505 | 5/1998 | Greer . |
| 5,988,645 | 11/1999 | Downing . |

*Primary Examiner*—Timothy V. Eley
*Assistant Examiner*—Dung Van Nguyen
(74) *Attorney, Agent, or Firm*—Lerner, David, Littenberg, Krumholz & Mentlik, LLP

(57) ABSTRACT

A guidewire position locator and a centerless grinder assembly including a guidewire position locator are disclosed. The guidewire position locator includes a plurality of optical sensors closely arranged to accurately detect the position of an elongate workpiece during machining operations.

9 Claims, 8 Drawing Sheets

GUIDEWIRE POSITION LOCATOR

CROSS REFERENCE TO RELATED APPLICATIONS

This application claims the benefit of provisional patent application serial No. 60/099,454 filed on Sep. 8, 1998, the disclosure of which is incorporated by reference herein.

FIELD OF THE INVENTION

The present invention relates to guide wire position locators. More particularly, the present invention relates to guide wire position locators that use optical sensors to detect the position of a workpiece. The present invention also relates to centerless grinder assemblies that include a guide wire position locator as part of the assembly.

BACKGROUND OF THE INVENTION

Guidewire position locators are useful for detecting and locating the position of a workpiece during manufacturing operations. Centerless grinders are manufacturing machine tools that can be used to grind elongate cylindrical workpieces such as wires, rods, pins, golf club shafts and the like. In order to meet the high demand for precision grinding operations, centerless grinder assemblies have been enhanced in recent years to include computer controlled guidewire position locators. For example, high quality systems are disclosed in U.S. Pat. Nos. 5,746,644 and 5,674,106, that are assigned to the same assignee as the present invention, Royal Master Grinders, Inc. of Oakland, N.J.

In order to understand why it is desirable to incorporate a guidewire position locator as part of a centerless grinder assembly, it is useful to be somewhat familiar with centerless grinder assemblies generally. A brief description of the process of using a centerless grinder as well as the structure and operation of traditional components of centerless grinders now follows.

The process of using a centerless grinder to machine elongate cylindrical workpieces is also known as grinding the workpieces or removing stock from the workpieces in order to obtain the desired configuration. Centerless grinders are particularly usefull where precision tolerances are required and where accurate profiles are desirable. Guidewire position locators facilitate the manufacture of workpieces under such conditions.

Centerless grinders include three main components. A work wheel, which is also known in the art as a grinding wheel, a regulating wheel and a work rest blade. The work wheel is the machine component that usually performs the actual removal of stock from the workpiece. The work wheel thus determines the surface finish and the overall configuration of the workpiece. The surface texture of the work wheel can be varied depending upon the particular grinding operation desired.

The regulating wheel is the machine component that directs and guides the workpiece to the work wheel. The regulating wheel is also responsible, in combination with the work wheel, for driving the workpiece and causing it to rotate during the grinding process.

The work rest blade is the machine component that provides support for the workpiece during machining (i.e., grinding) operations. The regulating wheel will cause the workpiece to rotate on the work rest blade while the work wheel removes the amount of stock required to obtain the desired diameter or taper of the associated workpiece. Prior art work rest blades include horizontal or angled support surfaces. The particular orientation of the work rest blade surface may be selected in accordance with the required configuration of the completed workpiece.

Royal Master Grinders, Inc. of Oakland, N.J. developed a centerless grinder having a guidewire position locator including individual photoelectric sensors that detect the position of the trailing end of the workpiece during machining operations. The detected signal is processed and causes the regulating wheel to change its position with respect to the work wheel so that the configuration of the workpiece is modified. As the trailing end of the workpiece is detected by additional sensors, further signals are generated and processed which may cause the regulating wheel to again change its position with respect to the work wheel. Accordingly, the machined workpiece may include one or more tapered sections. The tapered sections may be gradual, or abrupt, depending upon the desired configuration of the workpiece. Royal Master's aforementioned prior art centerless grinder is widely used in commercial practice.

The individual optical sensing elements of Royal Master's prior art centerless grinder are spaced from each other at about ½ inch intervals. Each of the optical sensing elements include an optical fiber that has the diameter of about 0.05 inch. The position locator system incorporated into Royal Master's prior art centerless grinder assembly is thus physically limited by the distance between the fiber optic sensing elements. Although Royal Master's centerless grinder is believed to be highly accurate in manufacturing workpieces that require precise dimensions and tapers, a need continues to exist to improve the accuracy.

A modified embodiment of the aforementioned centerless grinder includes independently adjustable individual sensors which can be arranged at a desired position with respect to the workpiece. Such independently adjustable individual sensors may require various adjustments in order to set the parameters of the associated centerless grinder machine to perform grinding operations that are sufficient to produce a workpiece having a customized configuration.

A need continues to exist in prior art centerless grinders to more accurately detect the position of the elongate workpiece during machining operations and to transmit detected data about the position of the elongate workpiece to an associated computer system so that any required adjustments can be made to assure that the workpiece is manufactured in accordance with required precise dimensions.

Notwithstanding the sophisticated and high quality systems developed by Royal Master Grinders, and other systems that may use various embodiments of optical guidewire position locators, a substantial need exists for an improved guidewire position locator, particularly for use with centerless grinders.

SUMMARY AND OBJECTS OF THE INVENTION

The present invention overcomes the shortcomings of prior art guidewire position locators and centerless grinder assemblies that include guidewire position locators. Although the present guidewire position locator is particularly effective when used in conjunction with a centerless grinder assembly, it may also be used as a stand alone system or as part of other grinding systems or other system to determine the location of various types of elongate workpieces during grinding and other manufacturing operations.

The present invention also fulfills prior art needs by providing a centerless grinder assembly that more accurately detects the position of an elongate workpiece during machining operations. The present system may be at least one to two magnitudes more accurate than any preexisting known centerless grinder system.

In a preferred embodiment, the guidewire position locator of the present invention comprises a support assembly for supporting an elongate workpiece having a leading end and a trailing end. A plurality of optical sensors are arranged on the support assembly. The optical sensors may comprise pixel linear array (PLA) sensors. Preferably, a light source is arranged between the elongate workpiece and the plurality of optical sensors. The light source may transmit a single beam of light for detection by the optical sensors as the trailing end of the elongate workpiece moves past the optical sensors.

Although various light sources may be used with the present invention, a preferable light source is one which generates a substantially focused light beam, as opposed to stray light that diverges or emanates from a light source. In order to obtain a desired focused light beam, the light source may include a lens.

In another preferred embodiment, the guidewire position locator comprises at least one mirror arranged at a selected angle with respect to the light source and the optical sensors to reflect incident light waves from the light source. The reflected light waves are successively detected by the plurality of optical sensors. The detected light waves may then be converted to position data by an associated computer system. The at least one mirror preferably comprises a plurality of mirrors arranged to reflect incident light waves from the light source to the plurality of optical sensors.

As used herein, the term "mirror" is intended to encompass various objects having a reflective surface or coating sufficient to reflect incident light waves from the coating to a target location. As used herein, the term "plurality of mirrors" is intended to include separate mirrors as well as a single mirror having two or more sides such that each side of the mirror may reflect light in a different direction.

In a preferred embodiment where the guidewire position locator comprises a plurality of mirrors, it is also desirable for the guidewire position locator to comprise a plurality of optical sensing elements that detect light waves reflected from one of the mirrors. The guidewire position locator may include a substantially transparent plate arranged between the light source and at least one of the mirrors. The substantially transparent plate may be made of glass or various other materials including, but not limited to, polymers, acrylics and plastics.

Preferably, the guidewire position locator comprises one or more PLA sensor assemblies where each sensor assembly includes a plurality of the optical sensing elements. In a preferred embodiment, the optical sensing elements may comprise a plurality of charge-mode pixels that form part of a PLA integrated circuit assembly. Three preferred PLA integrated circuit assemblies are manufactured by Texas Instruments as product numbers TSL218 and TSL208. The TSL 218/208 integrated circuit includes optical sensing elements spaced at 0.005 inch intervals while the TSL1410 IC includes optical sensing elements arranged at 0.0025 inch intervals.

It is also preferable for the guidewire position locator to comprise a computer system arranged to process signals generated by the plurality of optical PLA sensor assemblies in response to detection of light waves from the light source, such signals being indicative of the position of the trailing end of the elongate workpiece with respect to a referenced location.

In another embodiment, the guidewire position locator may not include an external light source. Such an embodiment may include optical sensor elements and corresponding circuitry that responds to ambient light.

In another preferred embodiment, the guidewire position locator comprises an optical sensor system including PLA integrated circuit assemblies and a computer system. The optical sensor system includes a plurality of optical PLA sensing elements arranged such that adjacent ones of said optical PLA sensing elements are no further than 0.156 inch from each other. Texas Instruments ICs TSL218, TSL208 and TSL1410 can be used in such a preferred embodiment. In this preferred embodiment, the optical PLA sensing elements are adapted to successively detect light waves as the trailing end of the elongate workpiece moves past corresponding ones of the PLA optical sensing elements. The optical PLA sensing system is intended in this preferred embodiment to continuously generate signals that are processed by the associated computer system where the processed signals are indicative of the position of the trailing end of the workpiece with respect to a referenced location.

In yet another preferred embodiment, a centerless grinder assembly is provided for machining elongate workpieces. The centerless grinder assembly preferably incorporates the features of the guidewire position locator embodiments discussed above. The centerless grinder assembly comprises a work wheel for removing stock from a workpiece and a regulating wheel arranged to cooperate with the work wheel to remove stock from the workpiece. A reference location (e.g., the "sizing feature") is arranged between the work wheel and the regulating wheel. A support assembly is also provided in this preferred embodiment and is arranged to support the elongate workpiece having a leading end and a trailing end during machining operations. The features of the guidewire position locator discussed above are incorporated into the centerless grinder assembly. Thus, the centerless grinder assembly includes, among other components, optical PLA sensors and other optical sensors arranged to detect incident light waves upon movement of the trailing end of the elongate workpiece during machining operations.

DETAILED DESCRIPTION OF THE PREFERRED EMBODIMENTS

Figure 3:
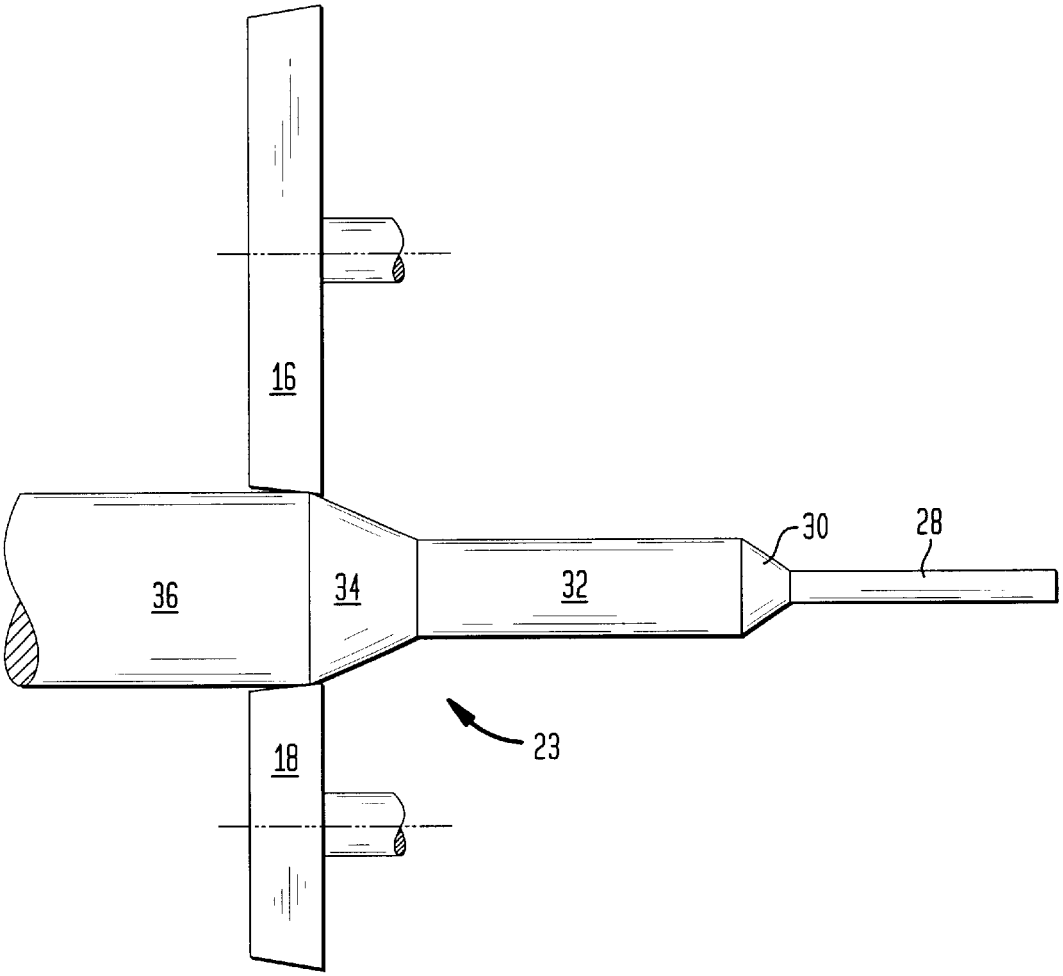
FIG. 3 is a top plan view of the grinding component shown in FIG. 2.

The guidewire position locator of the present invention will be described herein as a portion of a centerless grinder assembly. However, it should be appreciated that the guidewire position locator can be effectively used with various other manufacturing and gauging machines. Further, while the centerless grinder assembly 10 of the present invention will be described in preferred embodiments for manufacturing nonuniform workpieces, it can effectively be used to manufacture uniform workpieces (i.e., workpieces having a constant diameter along the entire length thereof). As used herein, the term "nonuniform" refers to the profile of a workpiece which does not consist only of a constant diameter along the length thereof. As shown in FIG. 3 workpiece 26 is an example of a nonuniform workpiece that includes both constant diameter sections and tapered sections.

Figure 1:
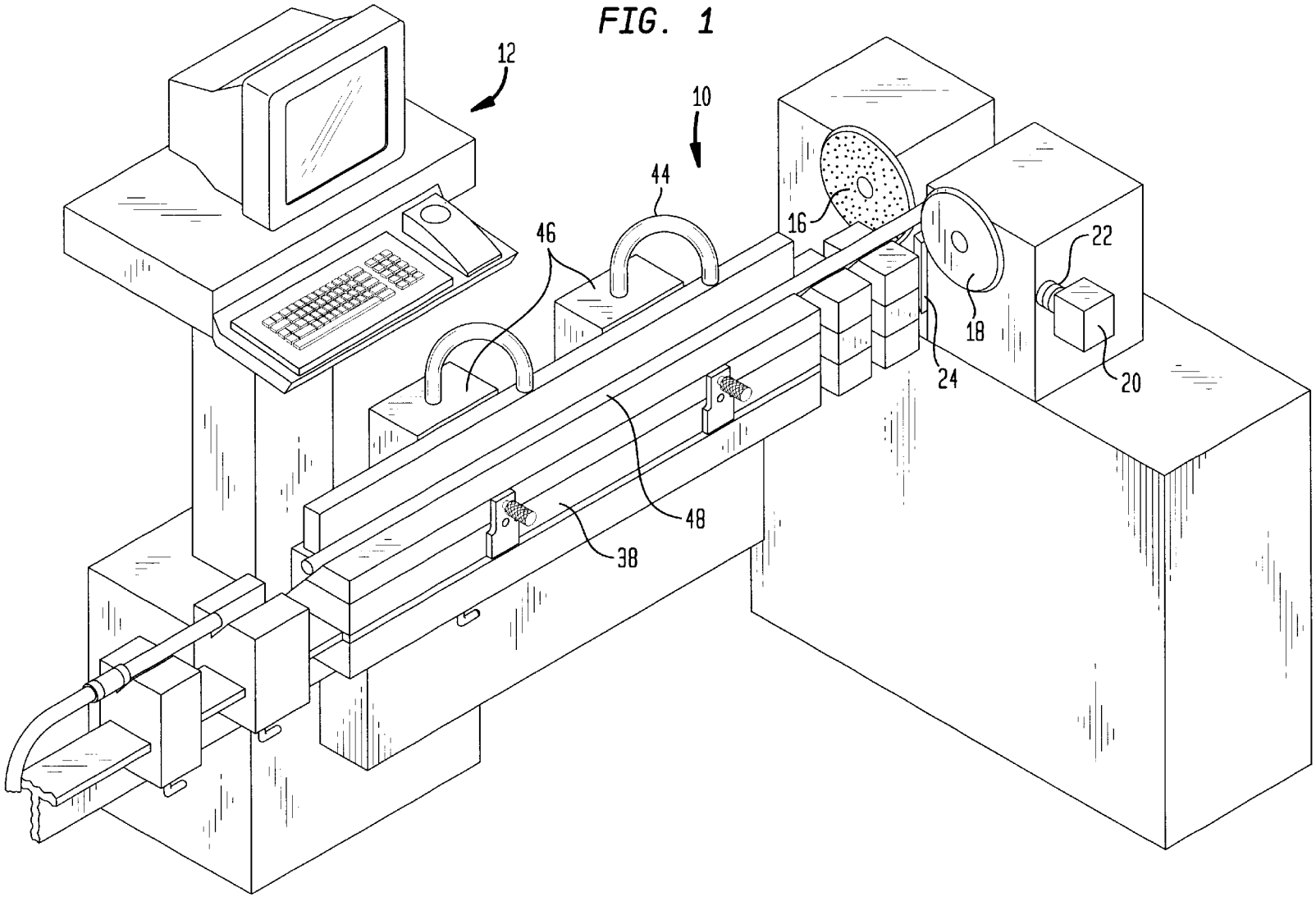
FIG. 1 is an isometric view of a centerless grinder assembly in accordance with the present invention.

The centerless grinder assembly 10 illustrated in FIG. 1 has certain features that are the same as, or highly similar to, the centerless grinder assembly described in U.S. Pat. No. 5,674,106. Thus, the subject matter of the '106 patent is incorporated by reference herein. The centerless grinder assembly 10 generally includes a computer system 12 for controlling its overall operation, a grinding assembly 14 and a sensor bank assembly 38.

The computer system 12 may be a general purpose computer, such as a personal computer having a state of the art microprocessor and sufficient memory to permit operation of associated software programs that may be customized for proper operation of the present invention.

The centerless grinder assembly 10 is preferably used to grind elongate workpieces. By way of example, in describing the structure and operation of the centerless grinder assembly 10, a wire workpiece 26 is used herein to describe a preferred elongate workpiece. The centerless grinder assembly 10 can be used to manufacture various elongate objects such as wires, pins, rods, shafts, etc. for many different uses.

Figure 2:
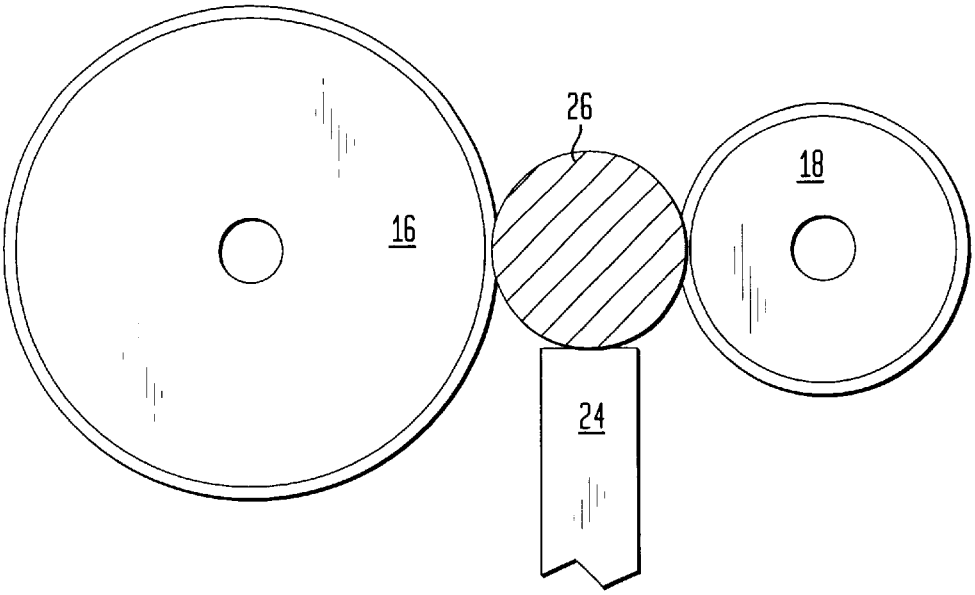
FIG. 2 is a schematic side view of selected components of the grinding assembly of the centerless grinder assembly shown in FIG. 1.

As shown in FIGS. 1 and 2, the grinding assembly 14 includes a work wheel 16 and a regulating wheel 18. The features of the work wheel 16 are known in the art. In a preferred embodiment, the work wheel 16 may have a twelve inch diameter. The features of the regulating wheel 18 are also known in the art. In a preferred embodiment, the regulating wheel 18 may have a diameter of about six inches. However, it should be understood that the dimensions of the work wheel 16 and the regulating wheel 18 can vary greatly in alternate embodiments and thus have been provided as examples only. A lead screw 22 and a precision stepping motor or servo motor 20 may be used to selectively drive the regulating wheel 18 toward or away from the work wheel 16 in response to signals generated and transmitted by the computer system 12. Devices other than the lead screw 22 and the motor 20 may be used to selectively drive the regulating wheel 18 toward or away from the work wheel 16.

A work rest blade 24 is arranged between the work wheel 16 and the regulating wheel 18 for supporting a workpiece 26 during machining operations. The support surface of the work rest blade 24 may be arranged in a horizontal plane, or may be arranged at an angle with respect to a horizontal plane. The angle of the work rest blade 24 effects the overall orientation of the machined workpiece 26.

A novel aspect of the present invention relates to the sensor bank assembly 38 which forms part of the guide wire position locator assembly. The sensor bank assembly 38 includes a plurality of optical PLA sensing elements, described further below, that are arranged much closer to each other than has heretofore been achieved in wire position locating devices and particularly in wire position locating devices used as part of a centerless grinder assembly.

FIG. 2 illustrates the nonuniform workpiece 26 as it is supported on a top support surface (unnumbered) of the work rest blade 24. The work rest blade 24 supports the workpiece 26 during the entire grinding process and permits the workpiece 26 to freely rotate on its top support surface during grinding operations.

As illustrated in FIG. 3, the work wheel 16 and the regulating wheel 18 have angled surfaces that enable the workpiece 26 to be precisely machined in accordance with a desired configuration. The regulating wheel 18 is preferably arranged at a slightly offset angle with respect to a vertical plane (not shown). The offset relationship of the regulating wheel 18 with respect to the vertical plane is known in the art and is useful to permit the regulating wheel 18 to draw the workpiece 26 past the work wheel 16 while continuously rotating the workpiece 26. As is also known in the art, the vertical component of the regulating wheel orientation is primarily responsible for causing the workpiece 26 to rotate (i.e., spin). The horizontal component of the regulating wheel orientation is primarily responsible for drawing the workpiece 26 past the work wheel 16.

As also shown in FIG. 3, the nonuniform profile of the workpiece 26 includes a front section 28 having a relatively small constant diameter, a front tapered section 30, a central constant diameter section 32, a rear tapered section 34 and a relatively large rear constant diameter section 36. The dimensions and profile of the various sections 28–36 are determined by the relative positions of the work wheel 16 and the regulating wheel 18. These positions are controlled by the computer system 12 of the centerless grinder assembly 10. The optical sensing elements of the present invention detect the trailing end 37 of the workpiece 26 and circuitry is used to send corresponding signals to the computer system where the signals are processed and translated into position data. As noted above, and discussed further below, one of the significant differences between the centerless grinder assembly 10 of the present invention and that disclosed in the '106 patent is that the optical sensing elements (such as the charge mode pixels of the PLA sensor circuits) are much closer together in the present invention. Thus, position data of the detected trailing end 37 of the workpiece 26 can be much more accurately determined during grinding operations so that the overall profile of the workpiece 26 may be more accurately machined.

Figure 4:
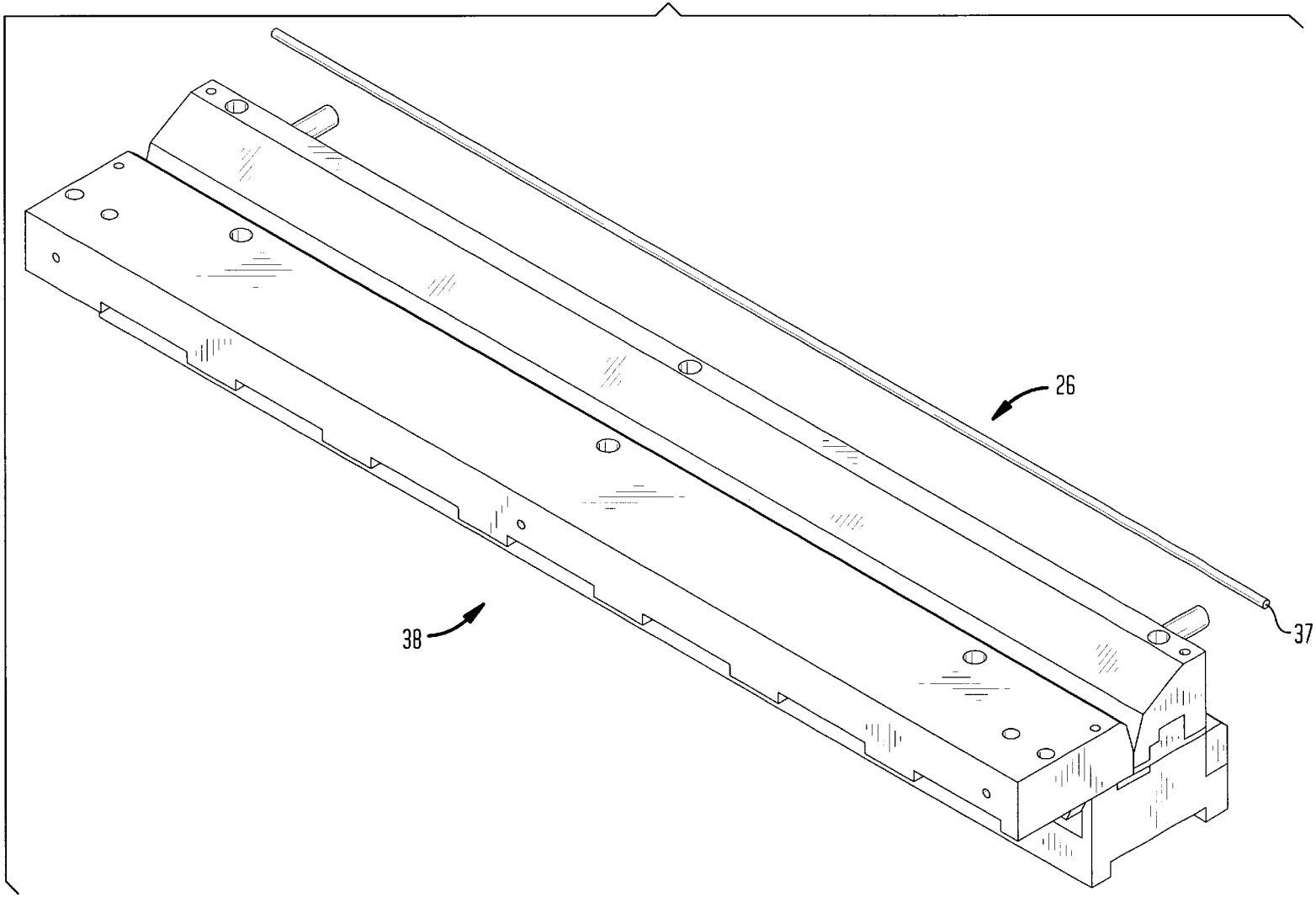
FIG. 4 is an isolated isometric view of selected components of the sensor bank assembly of FIG. 1.
Figure 5:
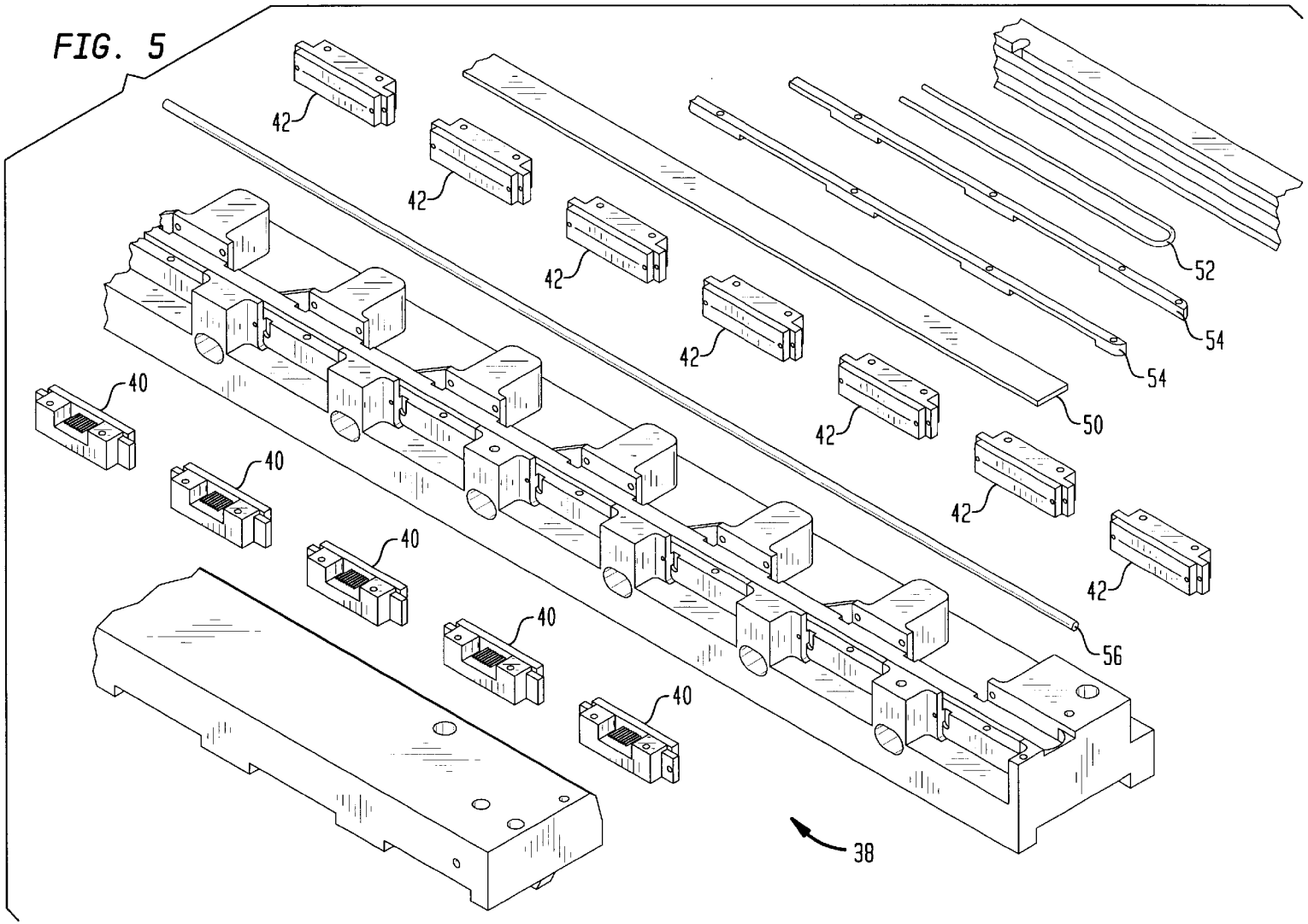
FIG. 5 is a partially exploded view of the sensor bank assembly of FIG. 4.
Figure 8:
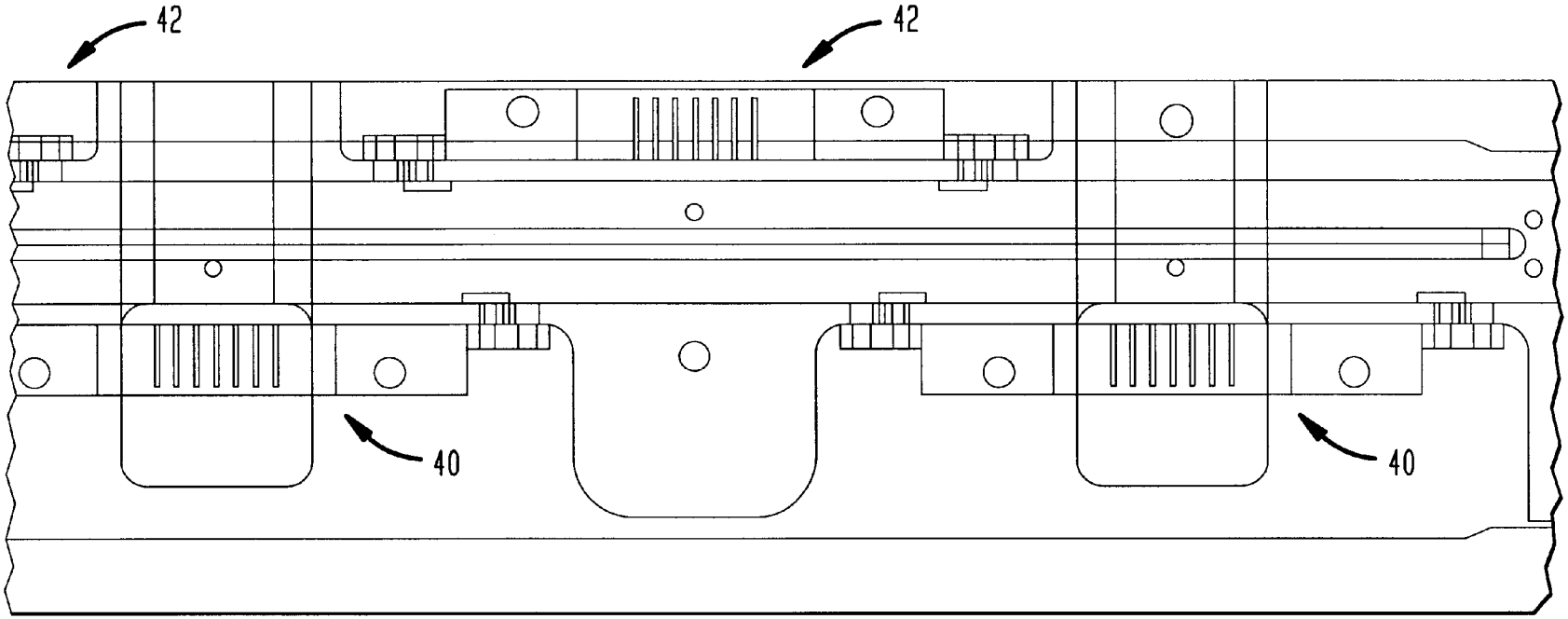
FIG. 8 is an isolated and enlarged schematic view of the alternating arrangement of sensor PLA assemblies in accordance with the present invention.

FIG. 4 schematically illustrates the sensor bank assembly 38 of the present guidewire position locator system. The sensor bank assembly 38 comprises a plurality of integrated circuits (not shown) arranged on opposing sides of the channel through which the workpiece 26 travels during machining operations. Each of the integrated circuits of the sensor bank assembly 38 include hundreds of optical PLA sensing elements. As shown in FIGS. 5 and 8, the integrated circuits are arranged within individual PLA sensor assemblies 40 and 42 that alternate on opposing sides of the workpiece 26.

The distance between the optical sensing elements in prior art centerless grinder assemblies is typically at least one half inch. In addition to being cost prohibitive for the prior art fiber sensing elements to be arranged much closer than one half inch from each other, the spacing distance was restricted by the size of the optical fiber itself. For example, a typical optical fiber used in the prior art Royal Master centerless grinder assembly included a diameter of about 0.05 inch with a shell of 0.156 diameter. This distance is in sharp contrast to the optical PLA sensing elements of the present invention which may be spaced at 0.005 inch intervals, 0.0025 inch intervals or closer.

FIGS. 5 and 8 illustrate the individual sensor assemblies 40 and 42 of the sensor bank assembly 38. There is no structural difference between individual sensor assemblies 40 and individual sensor assemblies 42. They have been given separate reference numbers to describe the alternating relationship on opposing sides of the channel through which the workpiece 26 is pulled as shown in FIGS. 5 and 8 and described further below. In a preferred embodiment, the heart of the individual PLA sensor assemblies may comprise an integrated circuit sold by Texas Instruments as product nos. TSL218, TSL208 and TSL1410. The TSL218/208 IC is an intelligent optosensor comprising eight dies (i.e., sections) each of which includes 64 charge-mode pixels (i.e., sensing elements) arranged in a 512 by 1 linear array. Each pixel measures about 120 micrometers by 70 micrometers with a center to center spacing of about 125 micrometers between adjacent pixels. They operate at clock speeds of 0.5 MHz and 2.0 MHz respectively. The TSL1410 IC is similar in structure and operation to the TSL218 IC except that the individual pixels are smaller and therefore arranged closer to each other. The center to center spacing of the pixels on the TSL1410 IC are believed to be about 62.5 micrometers. It operates at a clock speed of 2 MHz.

Accordingly, when the TSL218 or TSL208 ICs are used as part of the present centerless grinder assembly, there are approximately 100 sensing elements (pixels) for each half inch. This is two orders of magnitude greater than the sensor assembly of the prior art Royal Master centerless grinder where only one optical sensor element was arranged for each half inch.

Figure 9:
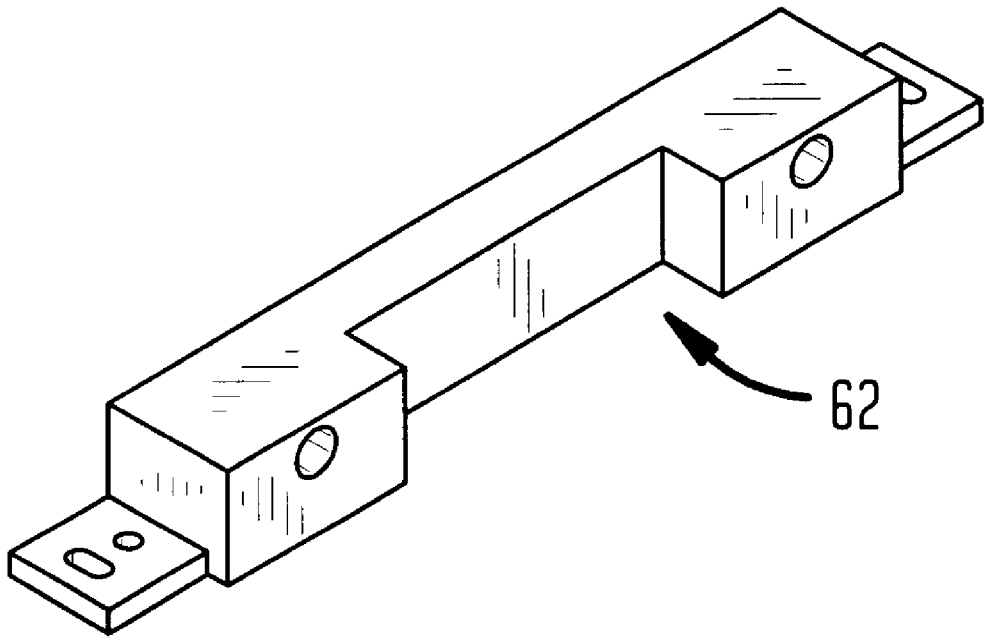
FIG. 9 is an isometric view of a bracket for a sensor assembly.

The sensor element ICs are preferably arranged in a bracket assembly 62 (shown in FIG. 9). The bracket assembly 62 is intended to secure the individual optoelectronic PLA ICs in assembled position as part of the sensor bank assembly 38.

As illustrated in FIGS. 5 and 8, the sensor PLA assemblies 40 are consecutively arranged on one side of the workpiece 26 while the sensor PLA assemblies 42 are consecutively arranged on the opposing side of the workpiece 26. Each sensor PLA assembly 40 and 42 is about 2.5 inches long. Each of the assemblies also includes "dead space" of about 0.25 inch at each end (or a total of about one half inch). There are no optoelectronic sensing elements (pixels) in the dead space. In order to eliminate the dead space from the sensing field of the sensor bank assembly 38, the opposing individual sensor assemblies 40 and 42 overlap as illustrated in FIG. 8.

Figure 6:
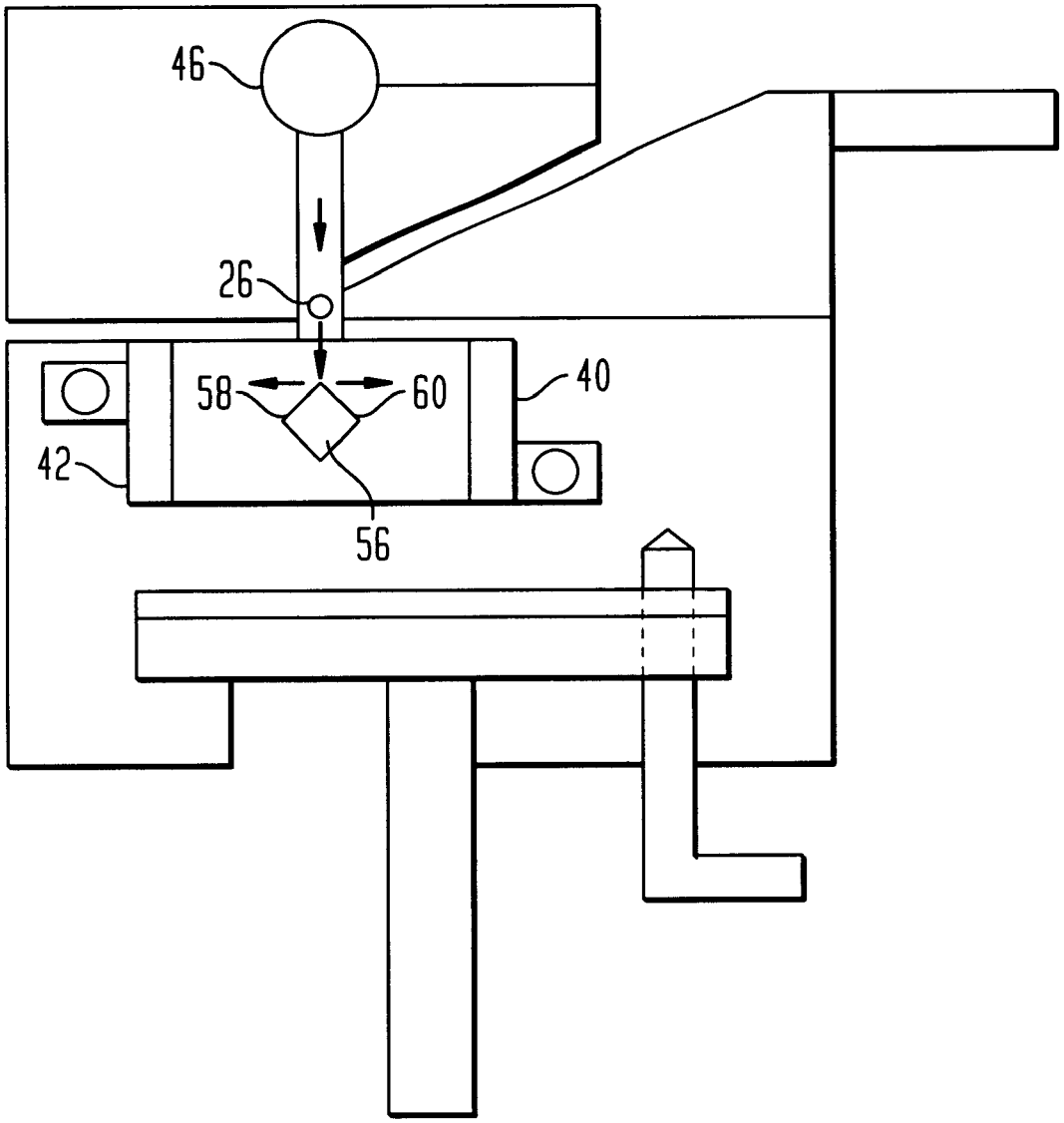
FIG. 6 is a schematic end view of the centerless grinder assembly taken along line VI—VI of FIG. 1.

While the overlapping relationship between opposing individual sensor assemblies 40 and 42 is useful to eliminate dead space, it also requires the creative arrangement of angled mirrored surfaces to reflect light to be detected by the sensor elements. This arrangement will be described further below. A light source 46 fed by fiber optic bundles 44 is illustrated in FIGS. 1 and 6. The light source 46 will direct light waves downwardly onto a lens 48, which focuses the light waves into a beam, as opposed to the usual stray light that emanates from a single light source. While various light sources may be used in accordance with the present invention, one preferred light source is available by Fostec as product no. A20500.2 with A089140.

Similarly, various lens attachments may be used to focus the light source. Fostec also provides a preferred lens attachment that is designed not to increase the light intensity, but to project a focused strip of light that essentially eliminates stray light components. Such a lens attachment is available from Fostec as product no. A08834. Alternate lens attachments may be used that actually increase the light intensity but such increase in light intensity is not necessary for adequate operation of the present invention. It should also be appreciated that while it is desirable to use a lens that will focus the light source into a tight beam, the present invention would work without the use of any lens. The present invention may also work without an external light source, but it is preferable to use an external light source to eliminate interference and errors which may otherwise be detected when ambient light is used as a source.

As shown in FIG. 5, a glass plate 50 may be arranged between the workpiece 26 and the individual sensor assemblies 40 and 42 in order to protect such PLA sensor assemblies from exposure to dust, dirt, etc. The glass plate 50 may be tightly secured and sealed in place by clamps 54 and seal 52.

Another novel aspect of the present invention is the use of a mirror 56 having opposing angled surfaces 58 and 60. The center of the mirror 56 is preferably arranged in the direct path of the light beam so that the beam falls incident on both surfaces 58 and 60. The light beam will therefore reflect to opposing sides of the PLA sensor bank assembly 38 where it is continuously picked up by the fixed sensing elements of opposing PLA sensor assemblies 40 and 42 as the trailing end 37 of workpiece 26 passes through the light beam.

Figure 7:
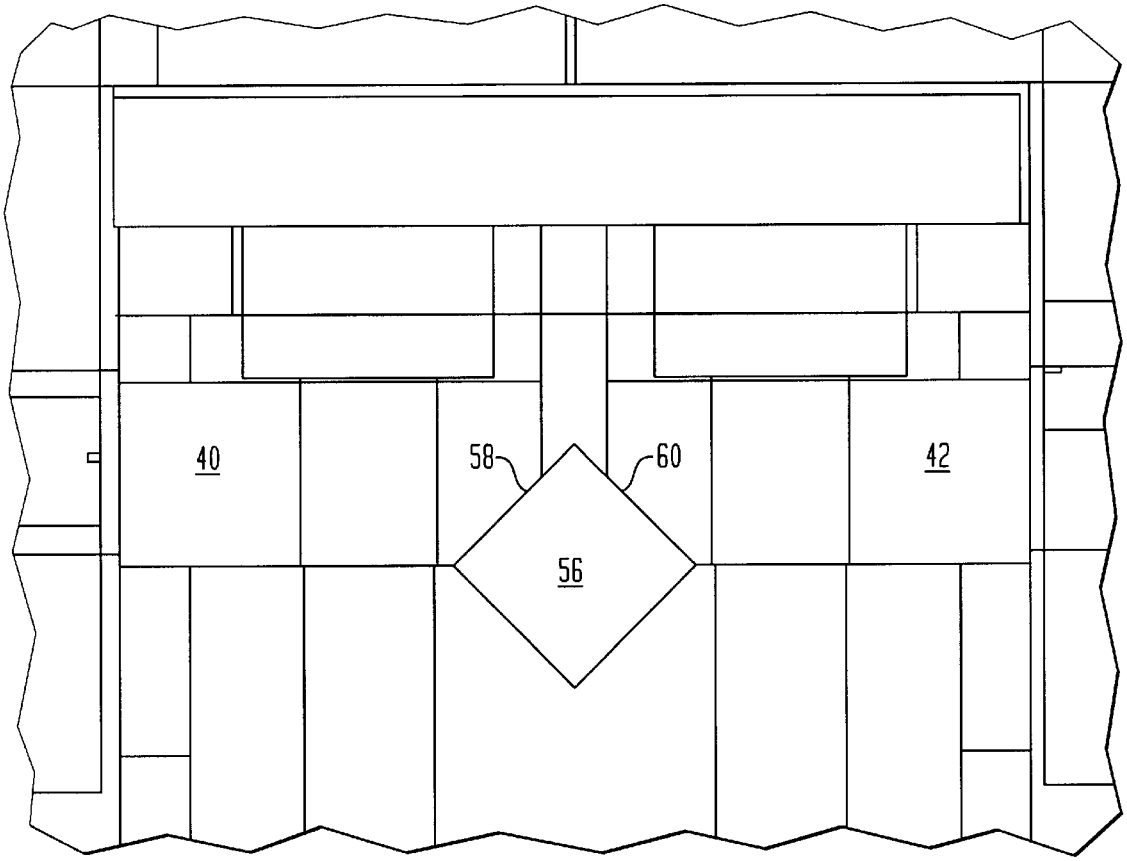
FIG. 7 is an isolated schematic view of the relationship between the sensor assembly and a multi-sided mirror in accordance with the present invention.

The mirror 56 may be made of any material having a reflective coating to deflect incident light to the target individual sensor assemblies 40 and 42. In a preferred embodiment, the mirror 56 may be made of steel, or other metal and may have a nickel or gold plating. In other preferred embodiments, the mirror may be made of glass having conventional metal reflective surface coatings. As shown in FIGS. 6 and 7, a single mirror 56 having first and second sides 58 and 60 arranged at desired angles is used to split an incident light beam for reflection to the desired individual PLA sensor assembly. For example, surface 58 may reflect incident light to one of the individual PLA sensor assemblies 40 while the second surface 60 may reflect incident light to an opposing one of the individual PLA sensor assemblies 42. In alternate embodiments, two separate mirrors arranged at the desired angle may be used in place of a single mirror having angled first and second surfaces. In a preferred embodiment, the angle between the first and second surfaces 58 and 60 of the mirror 56 is about 45 degrees. However, the surfaces of the mirror may be arranged at various angles sufficient to reflect incident light onto the target sensor assemblies. The surfaces of the mirror 56 may also be curved so as to further focus the light onto the pixels of the PLA sensors.

In an alternate embodiment, the present guidewire position locator may work without the use of mirrors. Such an alternate embodiment would require the sensor assemblies to be placed end to end over a substantially greater distance than the distance covered by the total length of the individual sensor assemblies 40 and 42 of the preferred embodiment described above.

In operation, the sensor bank assembly 38 works in conjunction with the computer system 12 as the workpiece 26 is machined by cooperation between the work wheel 16 and the regulating wheel 18. The alternating arrangement of the individual PLA sensor assemblies 40 and 42 in conjunction with the mirror 56 with angled first and second sides 58 and 60 to eliminate any dead spots for detecting the trailing end 37 of the workpiece 26 during machining operations.

Each of the 512 pixel sensing elements on each individual sensor assembly 40 and 42 consecutively detect light reflected from the corresponding surfaces 58 and 60 of the mirror 56 as the trailing end 37 of the workpiece 26 passes by a set reference location. The width of the workpiece 26 is sufficient when placed beneath the lens 48 to block the concentrated light beam from contacting the first and second surfaces 58 and 60 of the mirror 56. As the trailing end 37 of the workpiece 26 passes a certain portion of the lens 48, the concentrated light beam is permitted to fall incident on the first and second surfaces 58 and 60 of the mirror 56 and is subsequently reflected to the target pixel linear array sensing elements. The time between activation of adjacent pixel elements depends upon the velocity of the workpiece 26 as it is machined at the sizing feature location between the work wheel 16 and the regulating wheel 18. Of course, this is a very small amount of time due to the density of the individual pixel sensing elements.

As the sensing elements detect the incident light waves, a signal is processed by the associated IC and is converted into position information. The converted position signal is then transmitted to the CPU of the associated computer system 12 for processing.

As discussed above, movement of the regulating wheel 18 with respect to the work wheel 16 will effect the profile of the workpiece 26. For example, as the regulating wheel 18 is moved toward the work wheel 16, additional stock is removed from the workpiece 26 during grinding operations. Conversely, as the regulating wheel 18 is moved away from the work wheel 16, less stock is removed from the workpiece. A tapered profile will be obtained when the sizing feature (i.e., the distance between the work and regulating wheels) is modified during grinding operations by movement of the regulating wheel 18 with respect to the work wheel 16.

The extremely accurate and updated position information of the trailing end 37 of the workpiece is constantly fed to the computer system 12 and analyzed with respect to the sizing feature—the position of the regulating wheel 18 with respect to the work wheel 16 at a particular time. This system does not required calculations based on an assumed velocity as did various prior art systems.

The position information data obtained by the constant detection of the trailing end 37 of the workpiece 26 is processed by an algorithm of the computer system 12 to determine how many high and low counts are obtained. The output signal is a numerical count which may be converted to wire position, inches or mm used to activate the precision stepping motor 20 to rotate the lead screw 22 so that precise positioning of the work and regulating wheels 16 and 18 is obtained.

There are at least two algorithms that can be used with the optical PLA sensor system of the present invention. One such algorithm would require all PLA sensors to be connected in series so that the end pulse (S0) of the first PLA sensor will trigger the start pulse (S1) of the next PLA sensor, and so on until the chain is complete for all consecutively connected PLA sensors. This type of algorithm will take a total clock time proportional to the total number of charge mode pixels of each PLA sensor multiplied by the quantity of PLA sensors and divided by the clock sampling rate. For example, in a system that utilizes fourteen TSL218 PLA sensors having 512 pixels each (at a 0.005 inch pitch), the clock rate would be 0.5 MHz. This would require at least 0.014 seconds to sample the wire position. At a wire speed of one inch per second, this relates to 0.014 inch of error. The TSL208 IC operates at 2 MHz and requires 0.004 seconds corresponding to 0.004 inch error. The analog out (AO) of each pixel is switched momentarily from a common AO line to a counter. The counter counts the clock pulses while the analog signal is high (i.e., when it detects a light beam) as the trailing end 37 of the wire workpiece 26 passes a pixel of the PLA sensor assembly is detected. This number relates to the workpiece position by the count multiplied by the pitch of the pixel. The position of the wire workpiece 26 is used to control the corresponding grinder setting to obtain the desired profile of the workpiece.

In order to minimize timing errors and stray light errors, an alternate algorithm has been developed as part of the present invention. Instead of operating the PLA sensors in series, they may be operated in parallel. Each of the PLA sensors are started and clocked by SI and the clock pulse (CLK) simultaneously by the same SI and CLK signal. The analog signal from each PLA sensor is connected to two multiplexers (MUX) so that each MUX can detect any of the PLA sensors.

In a preferred embodiment, the optical sensing sensor may include fourteen PLA sensors. The single output of each MUX is connected to a digital signal processing board which counts the CLK pulses while the AO of each MUX is high. The algorithm detects when the high AO goes low and sends a four bit address to a programmable array logic or a gate array logic IC which then sends a corresponding address to a first MUX and an incremented address to a second MUX. The address is incremented when the position of the wire passes the halfway point of the PLA sensor being addressed by the second MUX. In this algorithm, the time is reduced to that of the clock time for one PLA sensor, independent of the number of PLA sensors used. For an assembly that uses fourteen TSL208 IC's, the clock time is 512/2,000,000 or 0.00026 seconds. This corresponds to 0.0003 inch error at a wire speed of one inch per second.

While the foregoing description is directed toward preferred embodiments of the present invention, it should be appreciated that numerous modifications can be made to various features of the present guidewire position locator and centerless grinder assembly while remaining within the scope and spirit of the present invention. Indeed, such modifications are encouraged to be made to the present centerless grinder assembly and associated guidewire position locator. Thus, the foregoing detailed description of the preferred embodiments should be taken by way of illustration rather than by way of limitation as the present invention is defined by the claims set forth below.

We claim:

1. A centerless grinder assembly for machining elongate workpieces, said centerless grinder assembly comprising:

a work wheel for removing stock from a workpiece; a regulating wheel arranged to cooperate with said work wheel in removing said stock from said workpiece; a reference location arranged between said work wheel and said regulating wheel; a support assembly arranged to support an elongate workpiece having a leading end a trailing end during machining operations; a plurality of optical sensors arranged on said support assembly; and a light source spaced from said elongate workpiece and said optical sensors and being operative to transmit a single beam of light for detection by said plurality of optical sensors upon movement of the trailing end of said elongate workpiece past at least one of said optical sensors.

2. The centerless grinder assembly of claim 1 further comprising at least one mirror arranged at a selected angle with respect to said light source and at least one of said optical sensors to reflect incident light waves from said light source to be successively detected by said plurality of optical sensors.

3. The centerless grinder assembly of claim 1 wherein said at least one mirror comprises a plurality of mirrors arranged to reflect incident light waves from said light source to said plurality of optical sensors.

4. The centerless grinder assembly of claim 1 further comprising a substantially transparent plate arranged between said light source and said at least one mirror.

5. The centerless grinder assembly of claim 1 wherein said plurality of optical sensors comprise at least one optical PLA sensor.

6. The centerless grinder assembly of claim 5 further comprising a computer system arranged to process signals generated by said plurality of optical PLA sensors in response to detection of light waves from said light source, said signals being indicative of the position of the trailing end of the elongate workpiece with respect to a reference location.

7. A centerless grinder assembly for machining elongate workpieces, said centerless grinder assembly comprising:

a work wheel for removing stock from a workpiece; a regulating wheel arranged to cooperate with said work wheel in removing said stock from said workpiece; a reference location arranged between said work wheel and said regulating wheel; a support assembly arranged to support an elongate workpiece having a leading end and a trailing end during machining operations; an optical sensing system including at least one integrated circuit assembly, said optical sensing system further including a plurality of optical sensing elements arranged such that adjacent ones of said optical sensing elements are no further than about 0.15 inch from each other; and a light source spaced from said elongate workpiece and said optical sensing system, said light source being operative to transmit a beam of light for detection by said plurality of optical sensing elements upon movement of the trailing end of said elongate workpiece past said optical sensing elements, whereby said optical sensing system being operative to continuously generate signals indicative of the position of said trailing end of said workpiece during machining operations.

8. The centerless grinder assembly of claim 7 further comprising at least one mirror arranged at a selected angle with respect to said light source and at least some of said optical sensing elements to reflect incident light waves from said light source for detection by said plurality of optical sensing elements.

9. The centerless grinder assembly of claim 8 wherein said at least one mirror comprises a plurality of mirrors, at least two of said plurality of mirrors being arranged to reflect light from said light source in different directions, said plurality of optical sensing elements being arranged on opposing sides of the elongate workpiece being machined, said optical sensors on opposing sides of the elongate workpiece being operative to detect light from corresponding ones of said mirrors.

* * * * *

UNITED STATES PATENT AND TRADEMARK OFFICE

CERTIFICATE OF CORRECTION

PATENT NO. : 6,227,938 B1
DATED : May 8, 2001
INVENTOR(S) : Cheetham et al.

It is certified that error appears in the above-identified patent and that said Letters Patent is hereby corrected as shown below:

Title page,
Item [73], Assignee, "Masters" should read -- Master --.

Column 10,
Line 57, after "end" insert -- and --.

Column 12,
Line 25, delete "sensing elements" and insert therefor -- sensors --.
Line 27, delete "sensors" and insert therefor -- sensing elements --.

Signed and Sealed this

Twenty-seventh Day of May, 2003

JAMES E. ROGAN
*Director of the United States Patent and Trademark Office*